United States Patent [19]

De Kruif

[11] Patent Number: 4,872,817

[45] Date of Patent: Oct. 10, 1989

[54] INTEGRAL DEFLECTION WASHER COMPRESSOR WHEEL

[75] Inventor: Jack De Kruif, Carson, Calif.

[73] Assignee: Allied-Signal Inc., Morristown, N.J.

[21] Appl. No.: 632,761

[22] Filed: Jul. 19, 1984

[51] Int. Cl.[4] ..... F04B 17/00

[52] U.S. Cl. ..... 417/407; 416/244 A

[58] Field of Search ..... 417/407; 403/2, 257; 46/244 A

[56] References Cited

U.S. PATENT DOCUMENTS 4,519,747 5/1985 Yamazaki et al. ..... 416/244 A

FOREIGN PATENT DOCUMENTS 3219006 7/1983 Fed. Rep. of Germany ... 416/244 A

*Primary Examiner*—Louis J. Caseregola
*Assistant Examiner*—T. S. Thorpe
*Attorney, Agent, or Firm*—Ken C. Decker; William N. Antonis

[57] ABSTRACT

An apparatus and method are disclosed which ensures that a rotor-shaft assembly is in rotational balance after assembly of the individually balanced components by preventing the creation of any imbalance during assembly. The rotor member is formed with an annular groove about the nose portion at a point near its mounting face, which during assembly is crimped before any shaft bending occurs, thereby eliminating any rotor-shaft imbalance.

3 Claims, 2 Drawing Sheets

INTEGRAL DEFLECTION WASHER COMPRESSOR WHEEL

BACKGROUND AND SUMMARY OF THE INVENTION

The present invention relates to the balancing of high speed rotational members and more particularly high speed rotational turbine wheels used in association with turbomachinery.

Inherent in all high speed rotating machinery is the critical problem of balance. This is especially true in the case of turbomachinery where in certain applications the speed can be as high as 100,000 RPM and in cases where there is a need to retain close tolerance between the rotating and the stationary parts. Imbalance of high speed rotational members can lead to early bearing failure as well as what is commonly referred to as "noise". Noise is generally measured in terms of g-levels created by the imbalance of the rotating member. It is well known that imbalance in a rotating member is created by the unsymmetrical distribution of weight about the axis of rotation. While an imbalance in any one piece can be reduced to tolerable levels by the trial and error method of balancing through the removal of material or the addition of material to the rotating piece, this method is time-consuming and labor intensive and therefore uneconomical. Since a turbine wheel for use in a turbocharger is composed of generally three distinct pieces; an integral turbine wheel and shaft, compressor impeller, and a nut which secures the compressor impeller to the shaft at the end opposite the turbine wheel, each piece must be individually balanced. Furthermore, assembly of the three balanced pieces does not assure that the assembled article will itself be balanced.

Another method of reducing imbalance which has gained popularity with turbocharger manufacturers consists of the steps of balancing the assembled rotor-shaft assembly outside of the turbocharger housing and marking each piece of the assembly with a scribe line before dissasembly. Thereafter, the pieces are reassembled within the turbocharger housing using the scribe line on each piece to ensure that the pieces have the same angular relationship to each other that they had when originally balanced. This procedure does not guarantee a balanced reassembled rotor-shaft assembly but does improve the probability thereof.

However, assembly of any two or more balanced pieces can result in an imbalanced final product; this imbalance is known as "created imbalance" since the imbalance arises during the assembly of the balanced pieces. "Created imbalance" is caused by the mounting faces of the assembly being out of square (not perpendicular) with respect to the axis of rotation of the shaft. Hence, tightening of the nut causes bending of the shaft member, thereby destroying any balance the assembly may have had when originally balanced. To date there is no known method or means of reducing or preventing what has been described as "created imbalance" other than the two unsatisfactory methods outlined above.

Broadly speaking, the present invention discloses an apparatus and method for eliminating or reducing an imbalance created during assembly of balanced parts thereby eliminating the need for rebalancing and ensuring that the rotor-shaft assembly is balanced in its assembled state.

According to the present invention there is provided a turbocharger turbine wheel assembly comprising a turbine wheel having an integral shaft coaxial therewith, a compressor impeller and a nut. The compressor impeller includes a hub portion, a plurality of radially outward extending blades from the hub, an annular slot formed about the hub and a coaxial bore through the hub. Each piece is individually balanced before assembly. The compressor impeller is coaxially mounted to the shaft and retained thereon by the use of the nut which is threaded onto the shaft. During tightening of the nut any misalignment of the nut or compressor impeller which could cause bending of the shaft and therefore create imbalance is accommodated by compression of the annular slot in the compressor impeller nose.

It is an object of the present invention to provide an apparatus and means for reducing or eliminating any imbalance which could be created during assembly of the balanced components.

It is another object of the present invention to provide a method of eliminating the need to rebalance a turbocharger compressor impeller- turbine wheel assembly made of individually balanced components.

It is a further object of the invention to prevent the creation of any bending moment about the shaft during assembly.

DETAILED DESCRIPTION OF THE PREFERRED EMBODIMENT

Although it will be apparent to those skilled in the art that machines incorporating the present invention can be constructed for operation of pumps, blowers, compressors, turbines and so forth, utilizing either gas or liquid as a working fluid medium, for purposes of illustration, the drawings and ensuing description are directed to an embodiment of the invention which has application as a high speed rotational rotor shaft assembly to be used in a turbocharger.

Figure 1:
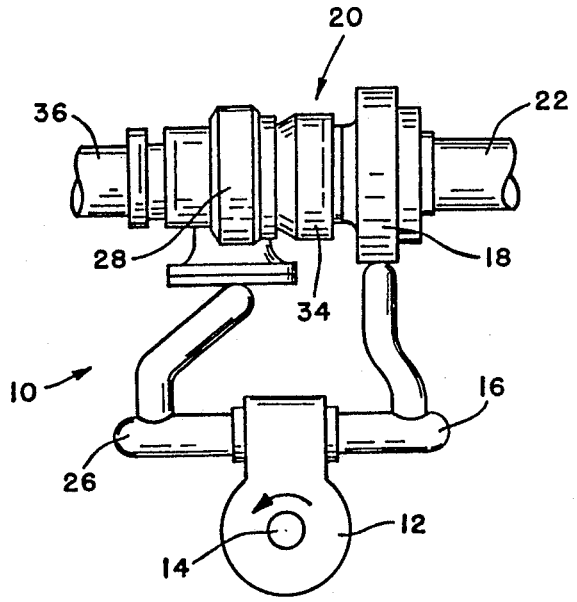
FIG. 1 is a diagrammatic view illustrating a turbocharger engine system including a rotor-shaft assembly of this invention.

A turbocharged engine system 10 is shown in FIG. 1 and generally comprises a combustion engine 12 such as an internal engine or diesel-powered engine having a plurality of combustion cylinders (not shown) for rotatably driving an engine crankshaft 14. The engine includes an air intake conduit or manifold 16 through which air is supplied by means of a compressor 18 of a turbocharger 20. In operation, the compressor draws in ambient air through an air inlet 22, and compresses the air with a rotatable compressor impeller or wheel 24 (shown in FIG. 2) to form charged air for supply to the engine 12 for combustion.

Exhaust products are discharged from the engine 12 through an exhaust conduit or manifold 26 for supply to a turbine 28 of the turbocharger 20. The discharged exhaust gases rotatably drive a turbine wheel 30 (shown in FIG. 2) at a relatively high rotational speed to correspondingly drive the compressor impeller 24 within the compressor 18. In this regard, the compressor impeller and turbine wheel, 24 and 30 respectively, are carried for simultaneous rotation on a common shaft 32 supported within a center housing 34. After driving communication with the turbine 28, the exhaust gases are discharged from the turbocharger 20 through an exhaust conduit 36 which may conveniently include pollution or noise abatement equipment.

Figure 2:
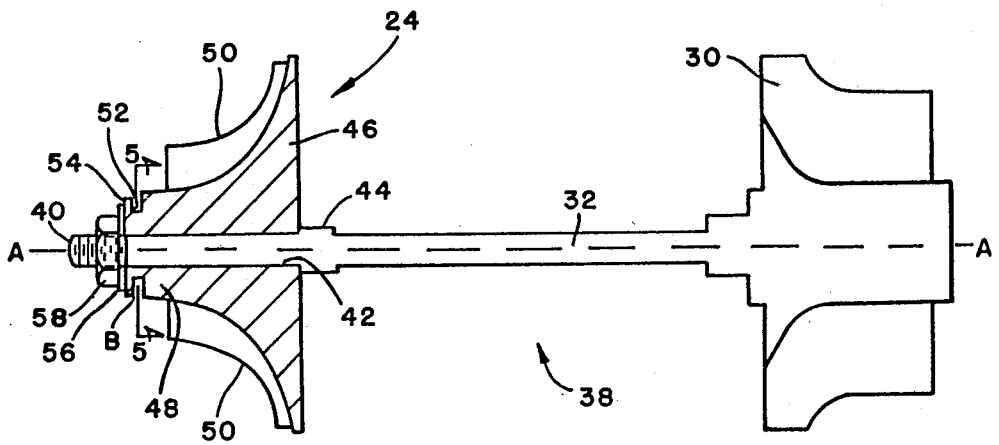
FIG. 2 is a partial cross-sectional side elevational view of a compressor impeller shaft-turbine wheel assembly of the type to be used in a turbocharger in accordance with the present invention.
Figure 4:
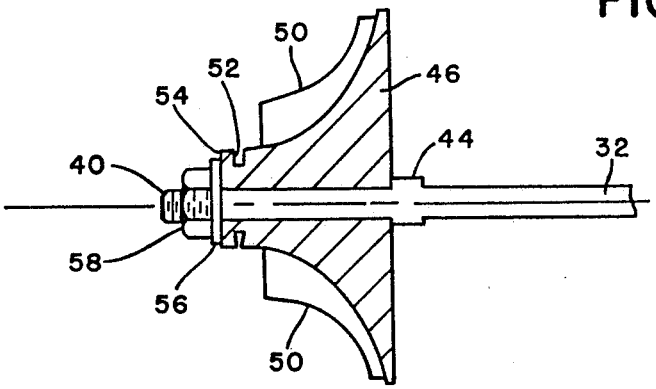
FIG. 4 is a partial cross sectional side elevational view of the rotor shaft assembly showing how the present invention operates in order to prevent "created imbalance".

Referring to FIGS. 2 and 4, shown is a rotor-shaft assembly to be used in a turbocharger. Shaft 32, having axis A—A about which it is balanced, rotatably carries thereon the coaxial turbine wheel 30 and a coaxial compressor impeller 24. The turbine wheel 30 and shaft 32 are normally constructed as an integral piece, however, it is envisioned that they may be friction welded or otherwise attached at the base of the turbine wheel 30. The shaft 32 is threaded at its end 40 which is opposite the turbine wheel. Compressor impeller 24, having a coaxial bore 42 therethrough, is mounted on the threaded end 40 of the shaft 32. There is a stop in the form of a raised land 44 or thrust collar (not shown) or other means on the shaft which limits or positions the impeller 24 axially on the shaft. As shown in FIGS. 2 and 4, the impeller 24 includes a hub 46 having a nose portion 48. A plurality of radially outwardly extending blades 50 are mounted to the hub 46. The nose portion 48 has an annular slot or groove 52 therearound. The outboard side (that side away from the center of the assembly) of the nose portion 48 forms a face 54 which is perpendicular with respect to the axis A—A of rotation. A washer 56 (optional) and nut 58 are used to secure the impeller 24 to the shaft 32. It is during the step of securing the impeller to the shaft which gives rise to the "created imbalance" of the type eliminated by the present invention.

Figure 3:
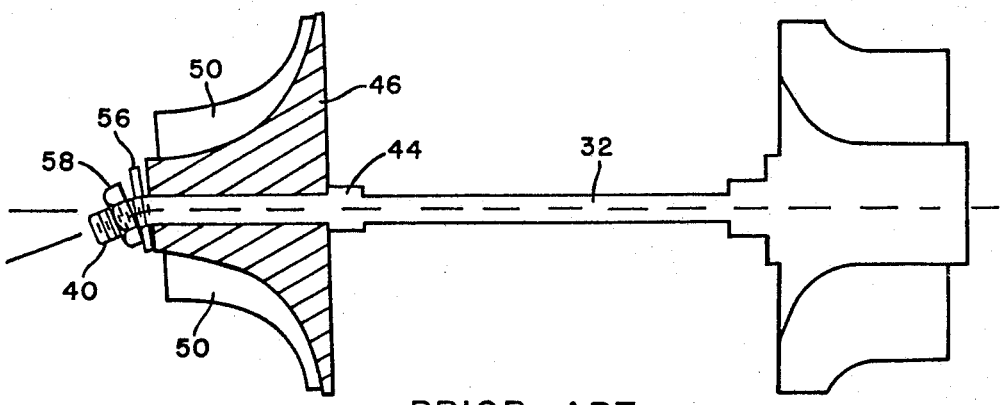
PRIOR ART FIG. 3
FIG. 3 is a view similar to FIG. 2, but showing prior art structure and illustrating "created imbalance in highly exaggerated form"

"Created imbalance" can be best explained by reference to FIGS. 3 and 4. In FIG. 3, a rotor-shaft assembly not employing the present invention is shown. Similar features as shown in FIG. 2 have been numbered the same in FIGS. 3 and 4. The major difference is that in FIG. 3 there is no nose portion or if there is, the nose portion 48 of hub 46 of compressor impeller 24 does not have an annular groove therein. During assembly of the balanced components, the compressor impeller 24 is slid onto the shaft 32 and can become skewed due to a burr or dirt, or improper alignment (not perpendicular to axis A—A) of the impeller face, or improper care of the assembler. The washer 56 and thereafter the nut 58 is threaded onto the shaft's end. During tightening of nut 58, the nut and washer will encounter one portion of the impeller nose face 54 (shown in FIG. 3 to be the bottom) before it encounters the top portion because of one of the reasons given above. When this happens, the application of more torque to the nut 58 will impart a radial component to the static forces which will operate against the shaft causing threaded end 40 of the shaft 32 to bend in the direction of the point of initial contact between washer 56 and impeller face 54. The bending of the shaft (shown in FIG. 3 in an exaggerated form) creates an imbalance at the end thereof. This imbalance therefore arises not from an imbalance of any one component, but from the bending of the shaft caused during assembly, hence the term "created imbalance".

FIG. 4 shows how the present invention prevents "created imbalance". As in FIG. 3, during assembly misalignment of the impeller 24 can result in contact between the washer 56 and nut 58 and the lower portion of the impeller nose face before contact with the top portion occurs. Tightening of the nut 58 causes the material of the nose between the washer 56 and the annular slot 52 to become deformed in a manner which pinches or crimps the axial width of the slot 52 in a radial arc-like manner in both the clockwise and counterclockwise directions from the point of initial contact between the nose of the impeller and the washer. Instead of causing the shaft to bend, the slot 52 is pinched closed at its bottom portion and remains open at its top portion. In effect, the crimping of the slot has not changed the radial distance of any appreciable amount of mass from the axis of rotation, or changed the amount of mass, or the angular disposition of the mass. Nor has the crimping of the slot imparted a radial component to the forces acting between the raised land 44, compressor impeller 24, washer 56 and nut 58. Hence, no bending of the shaft occurs, and the assembly remains dynamically balanced. Experimentation has shown that a rebalancing of the assembled rotor-shaft 38 is not necessary since the slot 52 has eliminated the creation of any imbalance during assembly.

Furthermore, it has been determined that each mounting face has the potential of being out of square with respect to the axis of the shaft. Since the washer has two mounting faces which must be in parallel alignment with each other and in a perpendicular relationship with axis A—A, experience has shown it best to not use a washer since it can contribute doubly to the probability of created imbalance. In the preferred embodiment, the nut 58 is tightened so that it is flush against the impeller nose face 56.

Figure 5A:
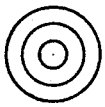
FIG. 5*a* and 5*b* are cross-sectional views of FIG. 2 taken along line 5—5 and show the preferred shape of the compressor impeller nose section within the groove and an alternative shape, respectively.
Figure 5B:
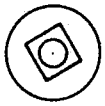

The exact location and size of the slot varies depending on the type of material used to make the impeller. It is most important that the material thickness between the impeller face and the slot be such that it resists cracking and chipping when the nut is tightened. Furthermore, the radial depth and axial width of the slot must be such that is large enough to accommodate deformation of the impeller nose in order to compensate for any misalignment of the impeller face or washer. In addition, the cross-sectional area of the groove or slot does not necessarily have to be circular in order to compensate for the misalignment of the mounting faces, (see FIG. 5). The size and location of the groove need only ensure that crimping of the groove occurs before bending of the shaft.

The present rotor-shaft assembly is practiced by rotatably balancing a shaft with or without a rotatably balanced turbine wheel securely and coaxially mounted to one end thereof forming an annular groove about the nose portion of the compressor impeller. The balance compressor impeller having a coaxial bore therethrough is slidable over the other end of the shaft which has been threaded. The axial distance the impeller is slid onto the shaft is controlled by forming a stop in the form of a shoulder or land means on the shaft. Thereafter, a nut is threaded onto the shaft and tightened against the impeller mounting face thereby securing the impeller between the land means and the nut. Tightening of the nut against the impeller face results in crimping of the annular groove and elimination of any out-of-squareness existing between the mounting faces of the impeller and nut.

The above described invention is further explained in the example given hereunder:

EXAMPLE

Six dimension alloy compressor impellers having a nose portion with a diameter of 0.600" (15.24 mm) at Point B (FIG. 2) and a compressor bore diameter of 0.250" (6.350 mm) were formed with an annual groove measuring approximately 0.040" (1.16 mm) in axial width and approximately 0.125" (3.275 mm) in radial depth. The groove was located 0.060" (1.74 mm) from the face of the impeller. The depth of the groove represents approximately 41% of the diameter of the impeller nose. It is understood that depending on the material used to construct the impeller, the out-of-squareness of the mounting faces and the diameter of the compressor bore, this ratio can vary significantly.

Figure 6:
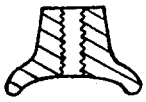
FIG. 6 is a cross-sectional side elevational view of a spherically seated nut.

Furthermore, it has been determined that if the radial depth of the groove is decreased to a ratio of approximately 20% of the diameter, created imbalance does not occur when a spherically seated nut is used as shown in FIG. 6. This type of nut ensures that the initial contact between the nut and the impeller mounting face occurs at the periphery of the mounting face, hence crimping of the groove occurs before bending of the shaft. It is also thought that the axial width can vary between 0.020" to 0.080" in size without any significant effects on the balancing results obtained when using the invention.

The impellers were thereafter secured to a previously balanced shaft turbine wheel assembly through the use of a nut. Thereafter, tests were performed with each unit on a vibration sorting stand at several different speeds to measure the noise level of each unit. Test results showed that five of the six units registered less than the acceptable 1.0 g noise limit, while the sixth unit narrowly failed to register below the acceptable 1.0 g noise level. Experience has taught that less than one in six compressor impellers not employing the present invention would register below the acceptable 1.0 g noise level.

Having described the invention with sufficient clarity that those skilled in the art may practice it, I claim:

1. A rotor-shaft assembly comprising:

a shaft having a mounting face thereon defined by a shoulder;

a rotor having two mounting faces and a nose portion;

means, having a mounting face, for securing said rotor to said shaft adjacent said shoulder in a rotatble relationship; and means, integral with said rotor, for preventing the rotation of imbalance of said rotor-shaft assembly during attachment of said rotor to said shaft, said means comprises an annular slot extending radially inward from the outer surface of said nose portion.

2. The rotor-shaft assembly of claim 1 wherein said shaft includes a coaxially mounted turbine wheel such that said shaft and turbine wheel are balanced.

3. The rotor-shaft assembly of claim 1 wherein said rotor is a compressor impeller.

* * * * *